United States Patent [19]

Larinoff

[11] Patent Number: 4,518,035

[45] Date of Patent: May 21, 1985

[54] AIR-COOLED, VACUUM STEAM CONDENSER

[75] Inventor: Michael W. Larinoff, Houston, Tex.

[73] Assignee: Hudson Products Corporation, Houston, Tex.

[21] Appl. No.: 465,815

[22] Filed: Feb. 14, 1983

[51] Int. Cl.[3] ..... F28F 27/02; F28B 3/00; F28B 9/10

[52] U.S. Cl. ..... 165/101; 165/111; 165/113; 165/DIG. 1; 60/693

[58] Field of Search ..... 165/101, DIG. 1, DIG. 24, 165/34, 39, 110, 111, 112, 113; 60/692, 693

[56] References Cited

U.S. PATENT DOCUMENTS

| | | | |
|---|---|---|---|
| 3,251,408 | 5/1966 | Watson et al. | 165/DIG. 1 |
| 3,289,742 | 12/1966 | Niemann | 165/111 |
| 3,660,980 | 5/1972 | Knirsch et al. | 165/113 |
| 4,045,961 | 9/1977 | Schoonman | 165/111 |
| 4,129,180 | 12/1978 | Larinoff | 165/111 |

FOREIGN PATENT DOCUMENTS

| | | | |
|---|---|---|---|
| 2257369 | 5/1974 | Fed. Rep. of Germany | 165/DIG. 1 |
| 1114971 | 4/1956 | France | 165/111 |
| 99583 | 7/1980 | Japan | 165/114 |
| 202490 | 12/1982 | Japan | 165/111 |
| 525317 | 8/1940 | United Kingdom | 165/113 |
| 978067 | 12/1964 | United Kingdom | 165/DIG. 1 |
| 1039218 | 8/1966 | United Kingdom | 165/111 |
| 1170415 | 11/1969 | United Kingdom | 165/DIG. 1 |

*Primary Examiner*—William R. Cline
*Assistant Examiner*—John K. Ford
*Attorney, Agent, or Firm*—Vaden, Eickenroht, Thompson & Jamison

[57] ABSTRACT

There is disclosed a mechanical draft, vacuum steam condenser for use in steam turbine power plant service which permits the operator to turn selected air moving fans on or off in order to control the quantity of air flow over the tubes of the tube bundles without interfering with the removal of non-condensible gases from the bundles serviced by the other fans.

2 Claims, 1 Drawing Figure

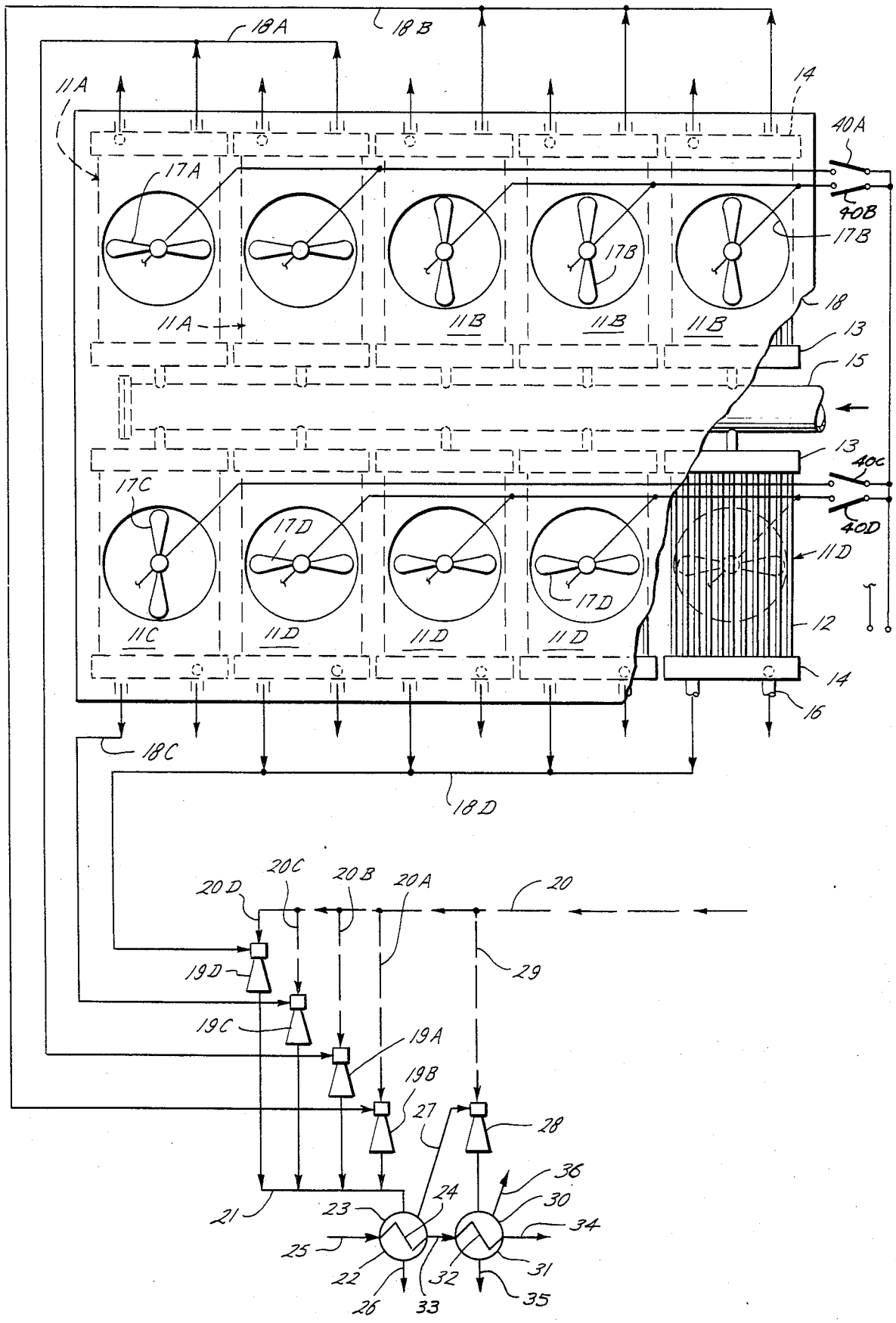
18A
18B
11A
14
40A
17A
40B
17B
17B
18
11A
11B
11B
11B
13
15
13
40C
17C
17D
40D
11D
17D
12
11C
11D
11D
11D
14
16
18C
18D
20C
20B
20A
20
20D
29
19D
19C
19A
19B
27
28
36
30
21
23
24
34
25
22
32
31
26
33
35

AIR-COOLED, VACUUM STEAM CONDENSER

This invention relates in general to a vacuum steam condenser for use in steam turbine power plant service in which cooling air is caused to pass over the tubes of the tube bundle thereof by means of air moving fans. More particularly, it relates to a condenser of this type having an improved system for controlling the quantity of air flow, and thus controlling the steam condensing capability of the condenser, by turning selected fans on or off.

In air-cooled steam condensers of this general type, it is necessary to continually remove non-condensible gases from the outlet headers of the bundles. Otherwise, these gases will collect and form stagnant pockets in the bundle tubes and headers which will freeze condensate in the winter and cause inefficient operation during the summer by blanketing heat transfer surfaces. Conventionally, non-condensible gases are so removed through vent condensers, dephlegmaters, or vent tubes connecting the bundle rear headers with a common manifold generally leading to the first stage of a steam jet ejector or other suitable equipment.

During low steam load conditions and/or cold weather, the operator needs to reduce the quantity of cooling air through the condenser. However, if this were to be done in current design condensers by merely shutting off certain fan motors while leaving others on, the resulting differences in steam flow rates pressure drops would cause a dangerous and damaging situation in which the tubes of the bundles serviced by the still operating fans would fill with non-condensible gases. To circumvent this, control proceedures are recommended by the manufacturer for cyclically turning some fans on and others off according to a predetermined operating regimen of about 15 minutes duration for each cycle. This fan cycling is intended to scavenge the non-condensible gases from those tubes that have accumulated these gases while allowing the bundles serviced by the operating fans to fill with non-condensible gases once more.

However, since all headers of conventional condensers of this type connect to a common manifold, these cyclic controls inherently interfere with operation of the system for removing non-condensible gases. Furthermore, some plant operators do not like to rely on a cyclic control system of this type because of its uncertainty, and hence it is the more common practice to place more reliance on equipment especially installed for controlling the amount of air passing over the tubes of each bundle, such as by means of louvers, multi-speed motors, variable speed fan drives, variable pitch fan blades, or combinations of them.

Equipment of this latter type is, however, quite costly and requires specialized maintenance and repair, and it is therefore the primary object of this invention to provide a condenser of this type in which air flow is controlled by on-off fan operation, but which does not require either costly control equipment or an operating system for cyclically turning each fan or groups of fans on or off, and which does not interfere with the operation of the non-condensible gas removal system.

These and other objects are accomplished, in accordance with the illustrated embodiment of the present invention, by a condenser of the type described wherein the bundles and fans are arranged in first and second sets of fan cells having respectively greater and lesser numbers of fans, and the means for removing non-condensibles from the outlet headers of the bundles includes first manifold means common to the outlet headers of the first set of fan cells, second manifold means common to the outlet headers of the second set of fan cells, first and second non-condensible gas removal means connected, respectively, with the first and second manifold means for extracting and then discharging the non-condensible gases therein to the atmosphere at a pressure which prevents backflow into the bundles via the manifold means, and means for turning the fan or fans of each fan cell on or off independently of one another.

As will be understood, in its most basic form, such a system provides four sets of performances by providing four different quantities of air flow due to the fans which the operator may select depending on that needed to condense a given quantity of steam, at a given steam pressure and at a given ambient air temperture. Obviously, the system may have additional sets of fan cells each having different numbers of fans, together with a manifold means common to each additional set, and means for turning the fan or fans of each cell of each additional set on or off independently of those of the other sets. Thus, for example, the condenser may include at least a third manifold means which is common to the outlet headers of a third set of fan cells having a greater number of fans than either the first or second set, a third independent non-condensible gas removal means connected to the third manifold means for extracting and then discharging the non-condensible gases therein to the atmosphere at a pressure which prevents backflow into the bundles via the third manifold means, and means for turning the fans of the third set on or off independently of those of the other sets of fan cells. Thus, the total air flow past the tubes may be further controlled by turning the fans of the third set on or off while the fans of the first and second sets are respectively turned on or off. Consequently, the addition to the system of the third set of fan cells and the third manifold means common to the outlet headers of the third set provides three additional performance ranges. In the illustrated embodiment of the invention, there are four such sets of fan cells and associated equipment to provide a total of eleven performance ranges via eleven total air flow variations.

In any event, it will be understood that this control system is not cyclical in the sense that it is time programmed to turn certain fans on while turning others off in accordance with an established operating regimen. Instead, fans which cause air to flow over the bundles of different sets of fan cells are turned either on or off in accordance with the selection of the plant operator or user, and operated that way for as long as necessary. It will further be understood that this system makes it possible to control the quantity of air flow without interfacing with the operation of the gas removal means, and yet requires no more than one additional air jet ejector or other non-condensible gas removal means for each set of fan cells in addition to the first set. Although the additional ejectors add to the capital cost of the equipment, this cost is very minor and is more than offset by the elimination of the need for either the cyclic control system or the other air flow control equipment of the type above described.

The only FIGURE of the drawing is a diagrammatic plan view of an air-cooled, vacuum steam condenser constructed in accordance with the present invention, including the system above described for controlling air flow past the tubes of the bundles thereof.

With reference now to the details of this drawing, the condenser includes two banks of tube bundles, with each bank forming one side of an "A"-frame, or, alternatively, with both banks arranged on generally the same level. Thus, two adjacent bundles 11A of the upper bank form one set of bundles, while three adjacent bundles 11B of the upper bank form a second set of bundles, and a single bundle 11C of the lower bank forms a third set of bundles, while four adjacent bundles 11D of the bank form a fourth set.

As shown, each bundles includes a plurality of tubes 12 having an inlet header 13 at one end and an outlet header 14 at the other end. Steam from a turbine exhaust is introduced into the inlet header of each tube bundle through a common manifold 15 extending the length of the banks of bundles, and condensate is removed from the outlet header of each bundle through a drain line 16.

In accordance with more conventional practice, there are two or more and usually four rows of tubes over which air is caused to pass successively, with all such rows connecting with common headers at each end. Alternately, each row of tubes may connect with a separate outlet header leading to individual vent tubes, as shown and described in my prior U.S. Pat. No. 4,129,180. Also, this invention contemplates that the condenser may include a vent condenser portion in addition to a main condenser portion, or, if desired, a dephalegmator or secondary condenser may be connected to each outlet header, all as well known in the art.

Air is caused to pass over the tubes of each bundle by means of a rotary fan mounted in a shroud 18 extending over the upper side of the tube bundle so as to draw air upwardly through the tubes of the bundle. Alternatively, the fan could be arranged to force air past the tubes of the bundle, and, of course, air may be caused to pass over the tubes of each bundle by more than one such fan. As shown, fans 17A are arranged above the first set of bundles 11A to form a first set of fan cells, fans 18B are arranged above the second set of tube bundles 11B to form a second set of fan cells, a fan 11C is arranged above the third bundle 11C to form a third set of fan cells, and fans 17D are arranged above a fourth set of bundles 11D to form a fourth set of fan cells.

As previously described, non-condensible gases are removed from the outlet headers of the tube bundles by a system which includes four manifolds 18A, 18B, 18C and 18D, each connecting the outlet headers of the sets of bundles 11A, 11B, 11C and 11D with first stage steam jet ejectors 19A, 19B, 19C and 19D, respectively. Thus, in the illustrated embodiment of the system, a first manifold 18A is common to the outlet header of the first set of tube bundles 11A, a second manifold 18B is common to the outlet headers of the second set of tube bundles 11B, a third manifold 18C is common to the outlet header of the third tube bundle 11C, and a fourth manifold 18D is common to the outlet headers of the fourth set of tube bundles 11D.

As shown diagrammatically in the drawing, the manifolds connect into the throats of the nozzles of the ejectors, and steam is passed through the nozzles by means of branch lines 20A, 20B, 20C and 20D of a main steam line 20. The motive steam is at a considerably higher pressure than that of the essentially subatmospheric pressure of the non-condensibles within the manifolds, so that it draws the latter through the nozzles and ejects it into the downstream ends of the lines 20A–20D, and these latter lines are in turn connected with a common line 21 leading to an inter-condenser 22.

Inter-condenser 22 comprises a shell 23 through which a tubing 24 extends for passing cooling water therethrough from a source which leads from supply line 25. Steam condensed in the inter-condenser is drained from the shell 23 through a line 26, while non-condensibles therein are drawn through a line 27 into the throat of the nozzle of a second stage ejector 28. Motive steam is supplied through another branch 29 of line 20 for passage through the nozzle of ejector 28 in order to eject the non-condensibles therein from the inter-condenser into an after-condenser 30.

After-condenser 30 is similar to the inter-condenser 22 in that it includes a shell 31 having a tubing 32 therein which receives cooling water from a line 33 leading from tubing 24 to circulate it through the after-condenser. Cooling water is removed from the after-condenser shell through a line 34 leading to a suitable point of disposal, while steam condensed in the after-condenser shell is drained therefrom through a line 35. All of the non-condensible gases that have entered the system are discharged to the atmosphere through a line 36.

The successive stages of the air removal equipment may take other forms, including motor driven vacuum pumps and the like, as shown, for example, in my aforementioned U.S. Pat. No. 4,129,180. It will also be understood that if the condenser were of the previously described construction, wherein each row of tubes comprised a separate bundles, the total number of manifolds and stages of air removal equipment would be multipled accordingly.

As also shown diagrammatically in the drawing, the motors of each fan of the fans 17A of the first set of fan cells for causing air to pass over the tubes of the first set of tube bundles 11A are electrically connected in parallel and are adapted to be turned on or off by a single switch 40A. In like manner, the motors of each fan of the fans 17B of the second set of fan cells for causing air to pass over the tubes of the second set of bundles 11B are electrically connected in parallel and are adapted to be turned on and off by a switch 40B, the motor of the fan of the fan 17C of the third set of fan cells for causing air to pass over the tubes of the third tube bundle 11C is adapted to be turned on or off by means of the switch 40C, and motor of each fan of the fans 17D of the third set of fan cells for causing air to pass over the tubes of the fourth set of tube bundles are electrically connected in parallel and are adapted to be turned on or off by means of a switch 40D. As also shown in the drawing, each switch is connected in an electrical circuit leading to and from a suitable source of electric power.

As previously indicated, this system enables the plant operator to select different quantities of air flow, depending on the circumstances encountered during use, without interfering with non-condensable gas removal sub-systems of the individual sets of fan cells—i.e., each set and its sub-system operates as a separate entity. Thus, for example, as previously mentioned and as will be more apparent from the table to follow, the system illustrated wherein four sets of fan cells are arranged and connected in the manner described enable the selection of eleven different ranges of increments of air flow, from a lower limit, when all the fans of all four sets are turned off, in which air flow is due solely to natural draft, to an upper limit, with the fans of all four sets turned on, in which all air flow past all the bundles is the result of mechanical draft. Thus, in the operation of the system, all fans of any given set of fan cells are either on or off. For example, the three fans 17B of the third set of fan cells should not be operated with two fans on and one fan off—i.e., all three are either on or off. On the other hand, the fans of one or more selected sets of fan cells may be turned on or off in such a manner as to cause air flow to vary within those limits as will be apparent from the following table:

| AIR FLOW REQUIRED (total fan cells in operation) | DESIGNATED FAN CELLS OPERATING |
|---|---|
| 0 | (Natural draft only) |
| 1 | Third Set (11C) |
| 2 | First Set (11A,11A) |
| 3 | Second Set (11B,11B,11B) |
| 4 | Fourth Set (11D,11D,11D,11D) |
| 5 | First & Second Sets (11A,11A,11B,11B,11B) |
| | Third & Fourth Sets (11C,11D,11D,11D,11D) |
| 6 | First & Fourth Sets (11A,11A,11D,11D,11D,11D) |
| | First, Second & Third Sets (11A,11A,11B, 11B,11B,11C) |
| 7 | Second & Fourth Sets (11B,11B,11B,11D, 11D,11D,11D) |
| | First, Third & Fourth Sets (11A,11A,11C, 11D,11D,11D,11D) |
| 8 | Second, First & Fourth Sets (11B,11B,11B,11C, 11D,11D,11D,11D) |
| 9 | First, Second & Fourth Sets (11A,11A,11B,11B, 11B,11D,11D,11D,11D) |
| 10 | First, Second, Third & Fourth Sets (11A,11A, 11B,11B,11B,11C,11D,11D,11D,11D) |

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. An air-cooled, vacuum steam condenser, comprising a plurality of tube bundles each having an inlet header for introducing steam into one end of the tubes, and an outlet header at the other end of the tubes of each bundle from which condensate may be removed, fans for causing air to pass over the tubes of the bundles and arranged with the bundles as first and second sets of fan cells, having respectively greater and lesser numbers of fans, means for removing non-condensible gases from the outlet headers of the bundles, including first manifold means common to the outlet headers of the first set of fan cells, second manifold means common to the outlet headers of the second set of fan cells, first and second independent non-condensible gas removal means connected, respectively, with said first and second manifold means for discharging the non-condensible gases therein to the atmosphere at a pressure which prevents backflow into the manifold means, and means for turning the fan or fans of each set on or off independently of the fan or fans of the other set, whereby the total air flow through the tubes of the bundles of said sets may be controlled by selectively turning the fans of both sets on or off, or turning the fan or fans of one set on and those of the other set off, without interfering with the non-condensible gas removal means connected with other sets.

2. A condenser of the character defined in claim 1, including third manifold means common to the outlet headers of a third set of fan cells a greater number of fans than either the first or second set, third independent non-condensible gas removal means connected with said third manifold means for discharging the non-condensible gas therein to the atmosphere at a pressure which prevents backflow into the manifold means, and means for turning the fan or fans of the third set on or off independently of the fan or fans of the first and second sets, whereby the total air flow through the tubes of the bundles of said first, second and third sets may be further controlled by selectively turning the fan or fans of the third set on or off while the fan or fans of the first and second sets are respectively turned on or off, without interfering with the non-condensible gas removal means connected with other sets.

* * * * *